US009469500B2

(12) United States Patent
Friedli

(10) Patent No.: US 9,469,500 B2
(45) Date of Patent: Oct. 18, 2016

(54) ELEVATOR RESERVATIONS USING DESTINATION ARRIVAL TIME

(71) Applicant: Inventio AG, Hergiswil (CH)

(72) Inventor: Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 406 days.

(21) Appl. No.: 14/359,313

(22) PCT Filed: Nov. 20, 2012

(86) PCT No.: PCT/EP2012/073113
§ 371 (c)(1),
(2) Date: May 20, 2014

(87) PCT Pub. No.: WO2013/076080
PCT Pub. Date: May 30, 2013

(65) Prior Publication Data

US 2014/0339023 A1 Nov. 20, 2014

(30) Foreign Application Priority Data

Nov. 22, 2011 (EP) ..... 11190098

(51) Int. Cl.
*B66B 1/20* (2006.01)
*B66B 1/24* (2006.01)
*B66B 1/46* (2006.01)

(52) U.S. Cl.
CPC ..... *B66B 1/2408* (2013.01); *B66B 1/468* (2013.01); *B66B 2201/232* (2013.01); *B66B 2201/463* (2013.01); *B66B 2201/4615* (2013.01); *B66B 2201/4653* (2013.01)

(58) Field of Classification Search
CPC ..... B66B 1/2408; B66B 1/468; B66B 2201/232; B66B 2201/4615; B66B 2201/463; B66B 2201/4653
USPC ..... 187/247, 380–388, 391, 392, 393, 396
See application file for complete search history.

(56) References Cited

U.S. PATENT DOCUMENTS 5,786,550 A * 7/1998 Thangavelu ..... B66B 1/2458 187/380
6,202,799 B1 * 3/2001 Drop ..... B66B 1/468 187/384
8,047,333 B2 * 11/2011 Finschi ..... B66B 1/468 187/382
8,210,321 B2 * 7/2012 Finschi ..... B66B 1/14 187/388
8,528,701 B2 * 9/2013 Schwarzentruber .... B66B 1/468 187/384
8,960,373 B2 * 2/2015 De Vincentis ..... B66B 1/2408 187/381

(Continued)

FOREIGN PATENT DOCUMENTS

EP 1873106 A1 1/2008
JP 2004043100 A 2/2004
WO 2007147927 A1 12/2007

*Primary Examiner* — Anthony Salata
(74) *Attorney, Agent, or Firm* — Fraser Clemens Martin & Miller LLC; William J. Clemens

(57) ABSTRACT

Use of an elevator system can be reserved for a passenger based at least in part on an indicated arrival time for a passenger trip. The passenger trip includes a portion that is carried out using the elevator system and an additional portion. The passenger's elevator reservation is scheduled such that time is allotted for the passenger to complete both trip portions by the indicated arrival time.

15 Claims, 9 Drawing Sheets

(56) References Cited

U.S. PATENT DOCUMENTS 9,323,232 B2 * 4/2016 Blom
2015/0251874 A1 * 9/2015 Salmikuukka ..... B66B 1/468 187/380
2015/0291388 A1 * 10/2015 Hovi ..... B66B 1/468 187/387
2016/0016755 A1 * 1/2016 Hanninen ..... B66B 1/2408 187/382
2016/0031675 A1 * 2/2016 Silvennoinen ..... B66B 1/34 187/247
2016/0060076 A1 * 3/2016 Schroeder-Brumloop ..... B66B 1/2408 187/247
2016/0083218 A1 * 3/2016 Vuorenala ..... B66B 3/006 187/247

* cited by examiner

ELEVATOR RESERVATIONS USING DESTINATION ARRIVAL TIME

FIELD

This disclosure relates to reserving the use of an elevator system.

BACKGROUND

Elevator passengers often take an elevator with the intent to arrive at a given destination by a certain time.

JP2004043100 describes a system that allows a passenger to reserve an elevator for use at a given time. The passenger can indicate a desired arrival time at a destination floor.

Further options for passengers using an elevator system as part of a journey could be advantageous.

SUMMARY

In various embodiments, use of an elevator system can be reserved for a passenger based at least in part on an indicated destination and an indicated destination arrival time for a passenger trip. The passenger trip comprises a portion that is carried out using the elevator system and an additional portion. A passenger's reservation for the elevator is scheduled such that time is allotted for the passenger to complete both portions by the indicated arrival time.

At least some embodiments of the disclosed methods comprise receiving a description of a passenger trip for a passenger, the passenger trip comprising an elevator portion and an additional portion, the description comprising a destination and a requested arrival time at the destination after completion of the additional portion and the elevator portion, and scheduling, for an elevator installation, an elevator call for the elevator portion of the passenger trip based on the destination and the requested arrival time. The methods can further comprise determining the elevator portion of the passenger trip and the additional portion of the passenger trip based on the destination and a starting point. The methods can also comprise determining a transit time for the elevator portion and a transit time for the additional portion. The transit time for the elevator portion can be based on one or more elevator system delays. Further embodiments comprise communicating an elevator departure time to the passenger. Additional embodiments comprise communicating to the passenger a departure time for the elevator portion or the additional portion. In some cases, the elevator portion occurs in the passenger trip before the additional portion. In other cases, the additional portion occurs in the passenger trip before the elevator portion. Some embodiments of the methods further comprise receiving the description of the passenger trip through a call input device and communicating a departure time for the passenger trip to a portable electronic device, the portable electronic device being separate from the call input device. In some cases, the elevator installation is in a building and the destination is outside of the building. The additional portion of the passenger trip can involve at least one motor vehicle.

Exemplary embodiments of an elevator installation can comprise: at least one elevator car disposed in an elevator shaft; an elevator control computer coupled to the at least one elevator car; and a trip planning computer coupled to the elevator control computer, the trip planning computer being configured to receive a description of a passenger trip, the passenger trip comprising an elevator portion and an additional portion, the description comprising a destination and a requested arrival time at the destination after completion of the additional portion and the elevator portion of the passenger trip and schedule, for the elevator installation, an elevator call for the elevator portion of the passenger trip based on the destination and the requested arrival time. The elevator installation can further comprise a call input device coupled to the elevator control computer or the trip planning computer. In some cases, the call input device is in a room that is a starting point of the passenger trip.

Further embodiments comprise a computer-based device configured to perform one or more of the disclosed methods.

At least some embodiments of the disclosed methods can be implemented using a computer or computer-based device that performs one or more method acts, the computer or computer-based device having read instructions for performing the method acts from one or more computer-readable storage media. The computer-readable storage media can comprise, for example, one or more optical disks, volatile memory components (such as DRAM or SRAM), and/or nonvolatile memory components (such as hard drives, Flash RAM or ROM). The computer readable storage media do not cover pure transitory signals. The methods disclosed herein are not performed solely in the human mind.

DESCRIPTION OF THE DRAWINGS

The disclosure refers to the following figures, in which.

DETAILED DESCRIPTION

Figure 1:
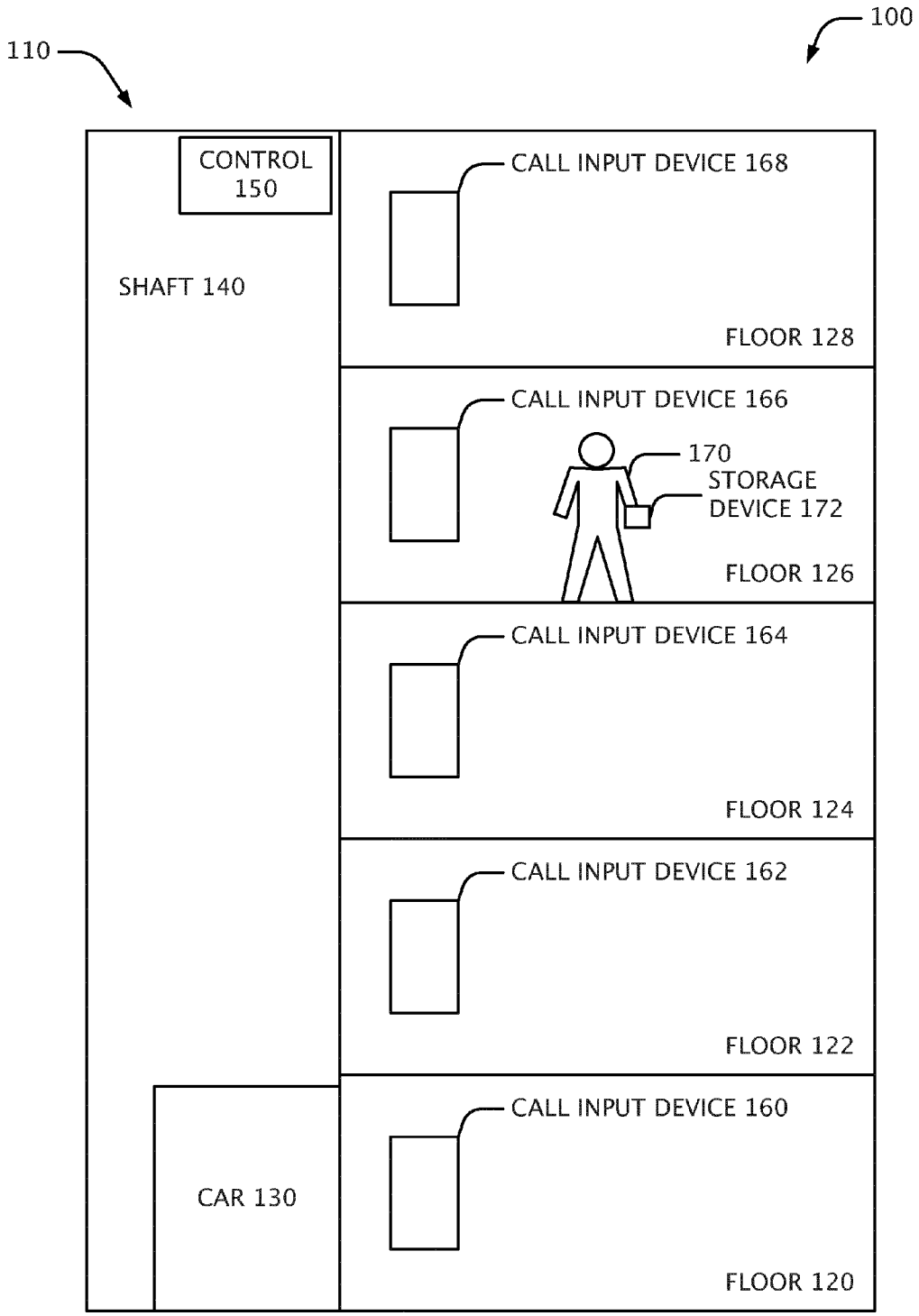
FIG. 1 is a block diagram of an exemplary embodiment of a building having an elevator installation.

FIG. 1 shows a block diagram of an exemplary embodiment of a building 100 having an elevator installation 110. The building 100 comprises a plurality of floors 120, 122, 124, 126, 128, which are served by the elevator installation 110. An elevator car 130 moves within a shaft 140 to reach the various floors 120, 122, 124, 126, 128. The car 130 can be moved using various components, which (to improve clarity) are not shown in FIG. 1. Operation of the elevator installation 110 is controlled by a computer-based control unit 150. The control unit 150 comprises, for example, at least one processor and at least one computer-readable storage medium that stores instructions for the processor. In FIG. 1, the floors 120, 122, 124, 126, 128 can house, for example, residences, offices, hotels, retail spaces and/or other facilities.

In at least some embodiments, the control unit 150 receives destination call signals from one or more destination call input devices 160, 162, 164, 166, 168, which are arranged on one or more of the floors 120, 122, 124, 126, 128, respectively. Generally, destination call input technology allows a destination for a user 170 to be determined before the user 170 enters the car 130. Such technology is sometimes referred to as "destination call control." In some cases, a data storage device 172 is used to transmit to the elevator installation 110 identifying information associated with the user 170. The data storage device 172 can comprise, for example: an RFID (radio-frequency identification) card, including near-field communication (NEC) devices and far-field communication devices; magnetic storage devices (e.g., magnetic strip cards); and/or optical code devices. The identifying information can comprise, for example, a number associated with the user 170, the name of the user 170 and/or other information. Based on the identifying information, the control unit 150 determines a destination for the user 170. In further embodiments, the user 170 (identified or unidentified) can input a destination using a destination call input device 160, 162, 164, 166, 168.

A call input device (e.g., call input devices 160, 162, 164, 166, 168) can be computer-based. The input device can comprise one or more input/output components, for example, a display, a touch screen, a wireless receiver and/or transmitter (based on, for example, Bluetooth technology, NFC technology, and/or RFID technology), a speaker, a microphone and/or a camera. The call input device can be a stationary or semi-stationary device placed in a hallway, inside a room (e.g., in an apartment or office), or in another location in or near the building 100. The call input device can also be at least partially implemented in a portable electronic device (e.g., a mobile telephone, a portable computer, a smartphone, a laptop, a personal digital assistant). In some cases, the call input device comprises a personal computer connected to a network.

In embodiments where the installation 110 comprises multiple elevator cars in multiple respective shafts (not shown in FIG. 1), the control unit 150 assigns the user 170 to a particular elevator car and communicates this assignment to the user 170. At least some embodiments of the disclosed technologies can be used with elevator systems having multiple cars in an elevator shaft, including double-deck elevator systems. The control unit 150 directs the car 130 to carry the user 170 to the destination floor.

Although the user 170 (also called "the passenger") is depicted herein as being a person, in various embodiments the user 170 can also be multiple people, a machine, an animal, a good and/or another object for transportation with the elevator installation.

Figure 2:
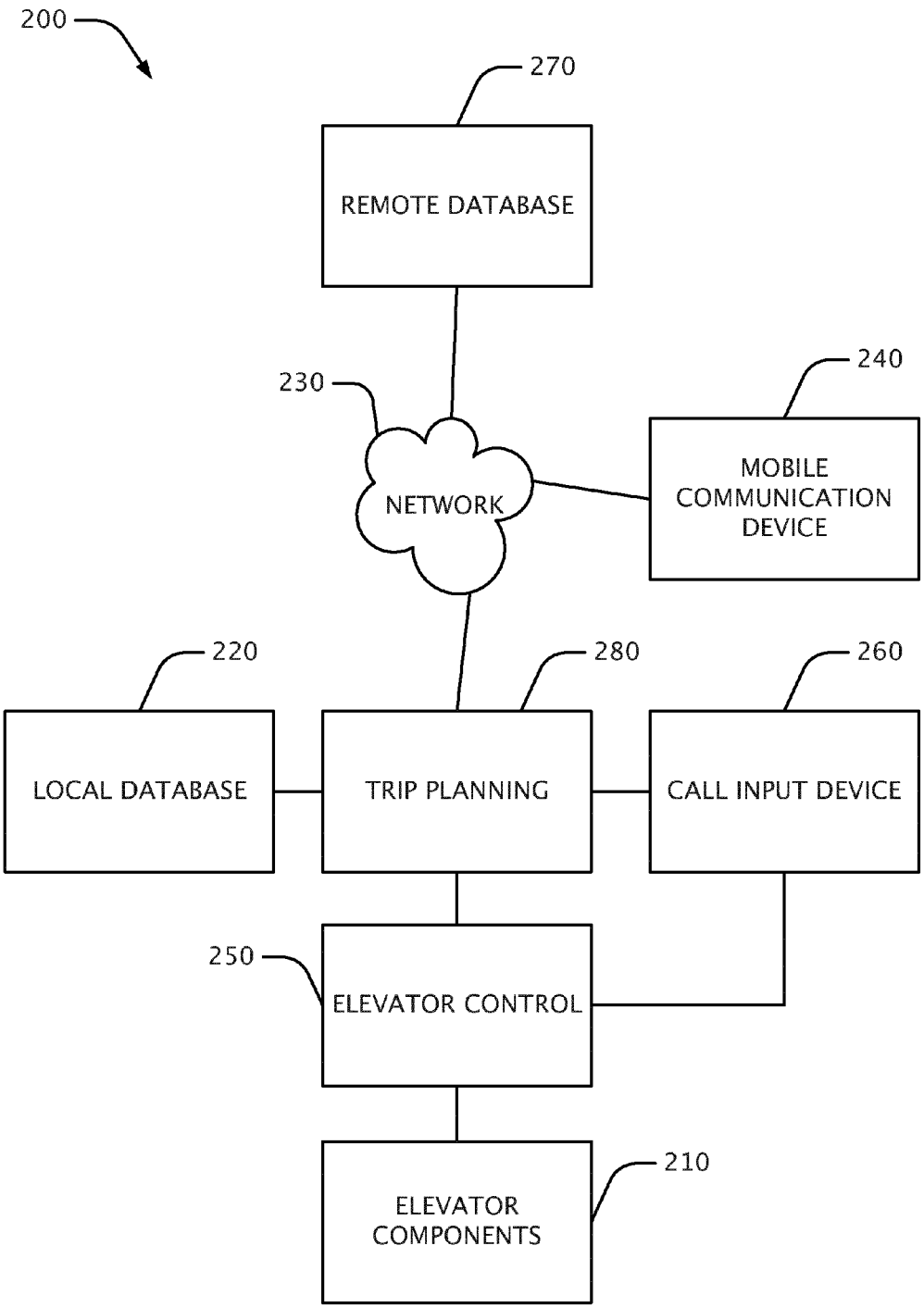
FIG. 2 shows a block diagram of an exemplary embodiment of a system for managing elevator reservations.

FIG. 2 shows a block diagram of an exemplary embodiment of a system 200 for managing elevator reservations. The system 200 comprises a trip planning unit 280, which is a computer-based device (the trip planning unit 280 is sometimes called a "trip planning computer"). The trip planning unit 280 is coupled to an elevator control unit 250 (also called an "elevator control computer"), which can be similar to the control unit 150. A call input device 260 is coupled to the trip planning unit 280 and/or to the elevator control 250.

The elevator control unit 250 is coupled to one or more elevator components 210. The elevator components 210 can be used to operate one or more portions of the elevator system, for example, motors, doors, and so forth.

The trip planning unit 280 can also be coupled to one or more local databases 220. The planning unit 280 can also be coupled to one or more networks 230 (e.g., local-area networks (LANs), wide-area networks (WANs), wireless networks, the Internet and/or telephone networks). Through the network 230, the planning unit 280 can be coupled to one or more mobile communication devices 240 (e.g., mobile telephones) and/or one or more remote databases 270.

The local databases 220 and/or the remote databases 270 contain information about, for example, maps, transportation conditions, available modes of transport, public transportation schedules, points of interest (e.g., possible destinations), possible elevator delays, out-of-service elevator cars, information about specific passengers, and/or elevator reservations.

Although the components of the system 200 are depicted as being discrete components, in further embodiments two or more of the components can be combined. For example, the trip planning unit 280 can be combined with the elevator control unit 250. In some embodiments, the components are located in a common location (e.g., in the same room or in the same building). In other embodiments, at least some of the components are located remotely from each other. For example, the trip planning unit 280 can be located remotely from the elevator control unit 250 and the associated elevator system. In that case, the trip planning unit 280 can communicate with the elevator control unit 250 over one or more networks.

Figure 3:
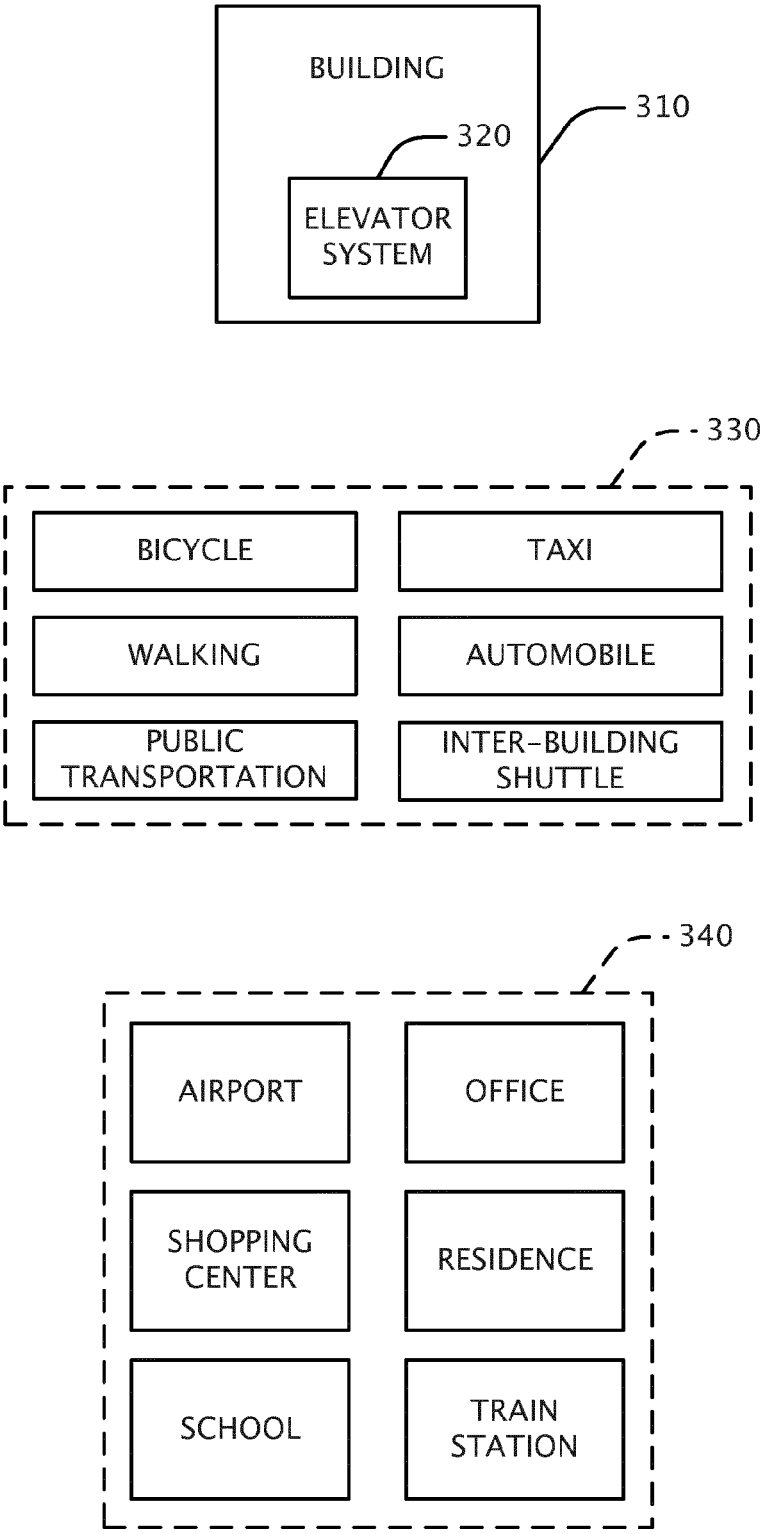
FIG. 3 shows exemplary embodiments of a building with an elevator system, possible modes of transportation and possible destinations.

People often use a combination of modes of transportation to reach a destination. For example, a person in a building may take an elevator and then a train to reach an airport. FIG. 3 shows exemplary elements for trips. More particularly, FIG. 3 shows a building 310 that is served by an elevator system 320. The elevator system 320 is configured to perform embodiments of one or more methods disclosed herein. FIG. 3 also shows exemplary transportation modes 330 that can be used to transport a person between the elevator system 320 and a destination. The modes 330 can include, for example, a bicycle, motor vehicles (e.g., taxi, automobile, bus), public transportation (e.g., train, bus, subway, streetcar), an inter-building shuttle and/or walking. Possible destinations 340 can include, for example, an airport, a shopping center, a school, an office, a residence and/or a train station. Other transportation modes and destinations are also possible.

Figure 4A:
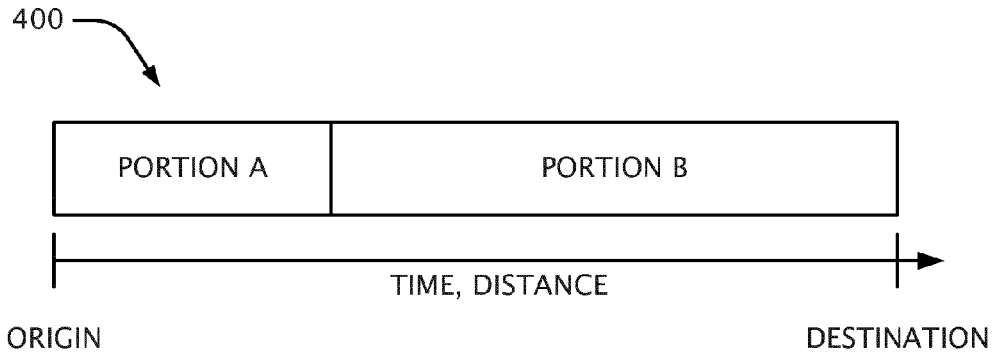
FIGS. 4A, 4B and 4C show exemplary depictions of passenger trips.

FIG. 4A visually depicts an example 400 of a passenger trip. Beginning at an origin point (depicted on the left-hand side of the figure), a passenger first completes a portion A of the trip, and then completes a portion B of the trip to reach a destination (depicted on the right-hand side of the figure). Portions A and B use different transportation modes.

Figure 4B:
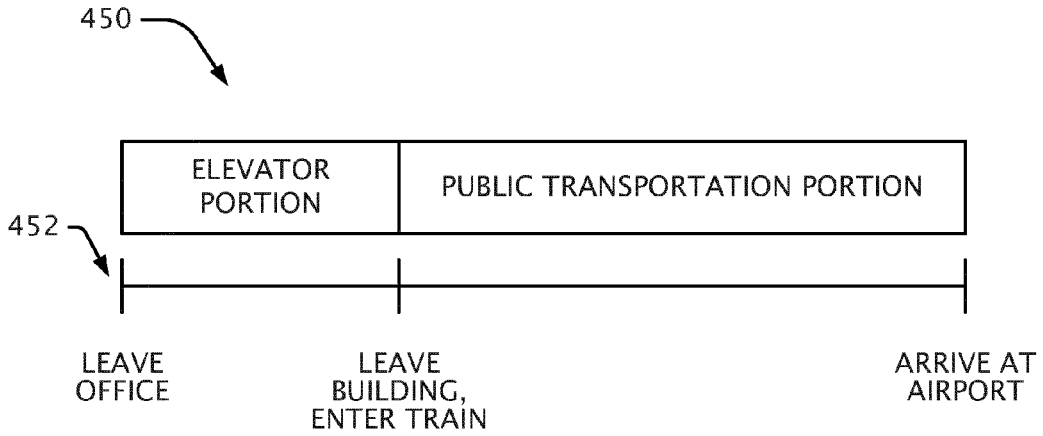

FIG. 4B depicts a more specific example 450 of a passenger trip. As indicated by a timeline 452 (in which time traveled and distance traveled increase from left to right), a passenger leaves an office and starts a first portion of the trip. In this case, the first portion is an "elevator portion," in which the passenger travels in an elevator installation in a building. As indicated by the timeline 452, upon completing the elevator portion, the passenger leaves the building and enters a train to the airport. Thus the second portion of the passenger trip begins, namely the "non-elevator portion," in which the passenger uses a mode of transportation other than an elevator. In this specific example, the non-elevator portion is a "public transportation portion." Upon completion of the public transportation portion (e.g., upon arrival of the train at the airport), the passenger has reached the destination.

Figure 4C:
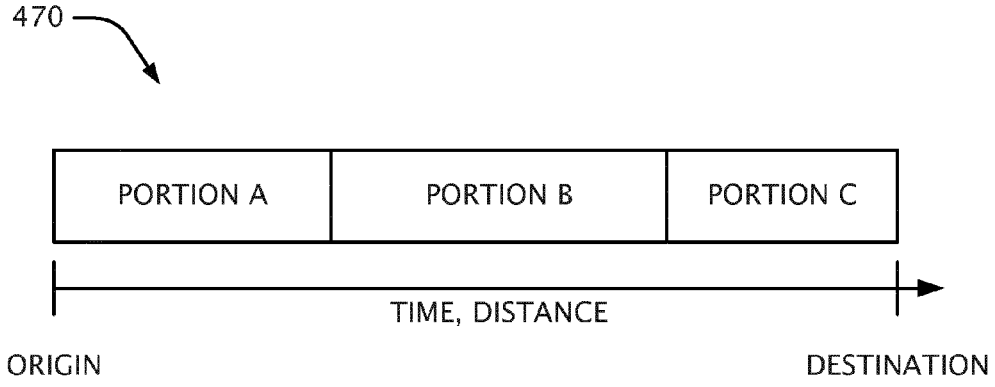

At least some embodiments of the disclosed technologies are not limited to passenger trips such as those specifically appearing in FIGS. 4A and 4B. For example, a passenger trip can comprise an elevator portion and a non-elevator portion, with the elevator portion occurring after the non-elevator portion. As an example of such a trip, a passenger could drive from his house to an office building, and then take an elevator from an entry floor of the office building to a meeting room in the building. As a further example of possible passenger trips, a passenger trip can comprise more than two portions, including multiple elevator portions and/or multiple portions that use transportation devices other than elevators. FIG. 4C shows an example 470 of a passenger trip comprising three portions (Portion A, Portion B and Portion C). In various embodiments, any of these three portions (including more than one portion) can be an elevator portion, and any of the three portions (including more than one portion) can be a non-elevator portion. Thus, example trips could include: taking an elevator, then taking a train, then taking a bus; taking a taxi, then walking, then taking an elevator; and taking a train, taking an elevator, then taking another train.

Figure 5:
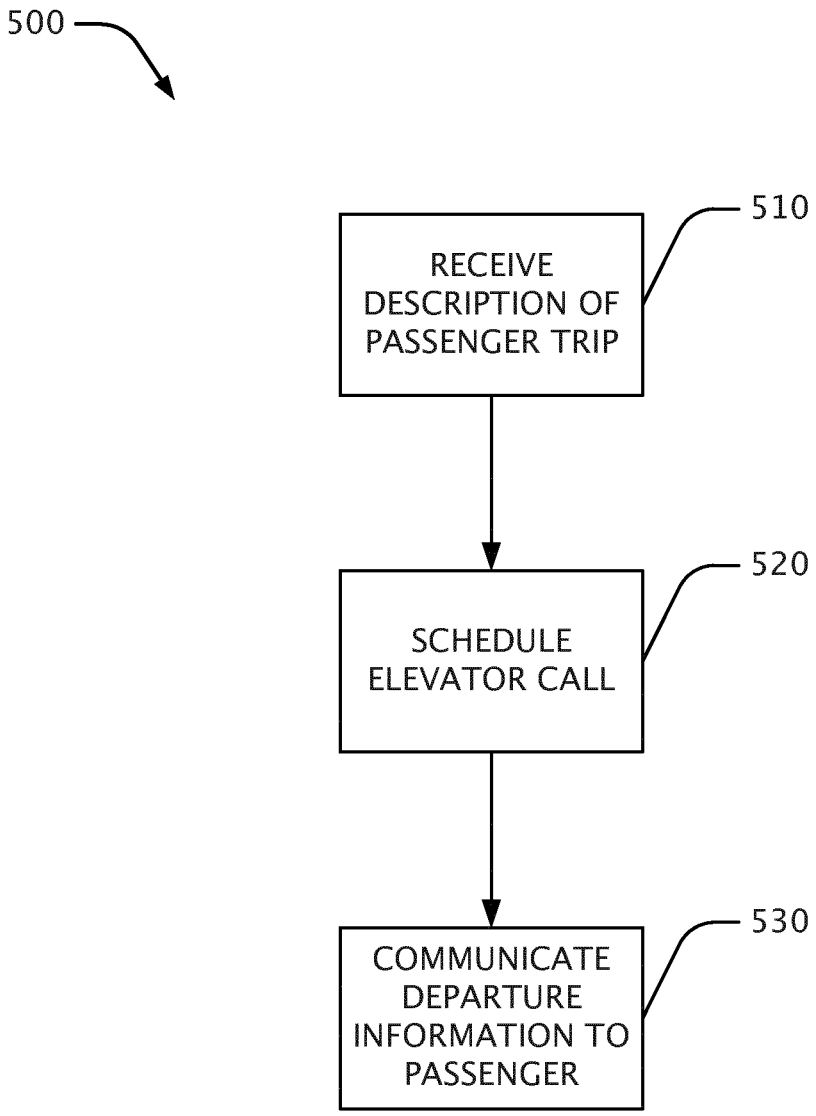
FIG. 5 shows a block diagram of an exemplary embodiment of a method of scheduling use of an elevator.

FIG. 5 shows a block diagram of an exemplary embodiment of a method 500 of scheduling use of an elevator. In a method act 510, a system for managing elevator reservations receives a description of a passenger trip. The description can be received from a call input device. In some embodiments, the description is received from a computer coupled to a network. The description can comprise, for example, a destination (e.g., "airport," "office" or "art museum") and a requested arrival time at the destination. In various embodiments, the passenger's end destination can be outside of a building served by the elevator installation or inside the building. The description can also comprise a starting point for the trip, though in some embodiments a default starting point can be used. The default starting point can be determined based on, for example, a location from which the description of the passenger trip is received (e.g., from a call input device in a given room) and/or from a current location of the passenger. The arrival time can be expressed in terms of a specific time (e.g., "9 AM") or in terms of a relative time (e.g., "no later than 9 AM," "in two hours," "start of last museum tour for today"). In further embodiments, the description includes one or more modes of transportation for traveling between the elevator installation and the destination or origin.

In a method act 520, the system schedules an elevator call for the passenger trip based on the description. For example, the system schedules a time when an elevator car in the elevator system will be ready to pick up the passenger. The scheduled elevator call allows sufficient time for the passenger to complete the elevator portion of the trip, complete an additional portion of the trip (e.g., by another mode of transportation), and arrive at the destination by the desired arrival time.

In a method act 530, departure information is communicated to the passenger. For example, information about the scheduled elevator call (the "reservation") can be communicated to the passenger. Such information can include, for example, a departure time for the elevator and an elevator assignment. In additional embodiments (including, for example, where the first portion of the trip is a non-elevator trip), information about when to depart with a specific mode of transportation (e.g., when to catch a train, when to depart by automobile) is provided to the passenger. In further embodiments, one or more reminders are sent to the passenger as the departure time approaches.

Figure 6:
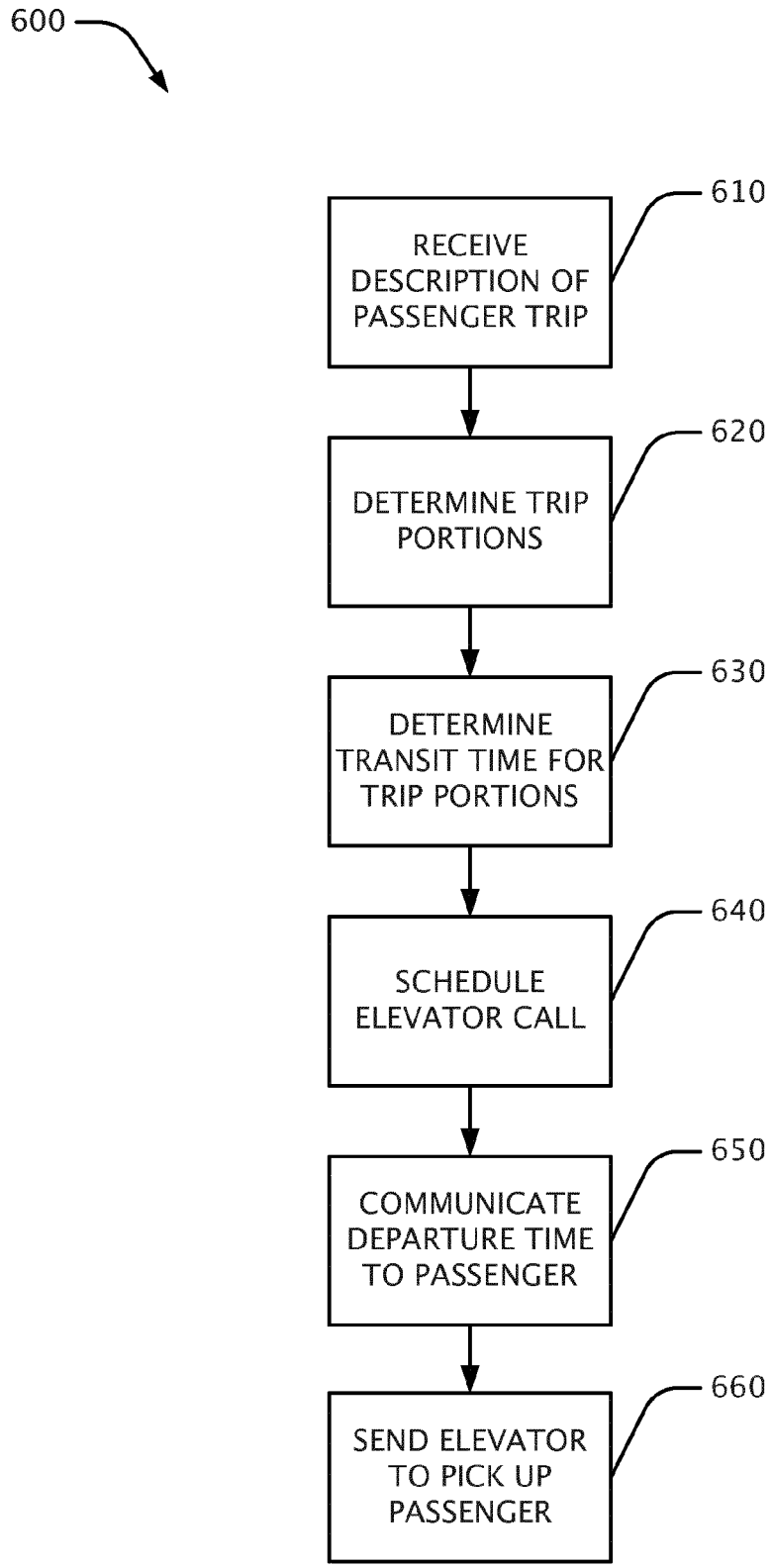
FIG. 6 shows a block diagram of an exemplary embodiment of a method of scheduling use of an elevator.

FIG. 6 shows a block diagram of an exemplary embodiment of a method 600 of scheduling use of an elevator. In a method act 610, a description of a passenger trip is received by a system for managing elevator reservations. The description can be received from a call input device. In some embodiments, the description is received from a computer coupled to a network (e.g., over the Internet).

In a method act 620, two or more trip portions are determined based on the trip description. For example, if a passenger trip consists of traveling from a hotel to the airport, the system can determine that the trip portions include an elevator portion (e.g., traveling by elevator from the floor of the passenger's hotel room to the hotel lobby on the ground floor) and a taxi portion (e.g., traveling by taxi from the hotel lobby to the airport). As another example, if a passenger is traveling from a train station to an apartment in a high-rise building, the system can determine that the trip portions include a bus portion (e.g., traveling from the train station to the bus stop near the high-rise building) and an elevator portion (e.g., traveling from the lobby of the high-rise building to the floor of the apartment).

The trip portions can be determined using any number of path computation techniques. Example techniques can be similar to those used by software programs that plan travel routes and/or driving directions. In particular embodiments, the trip portions are determined using a look-up table. The method act 620 can be performed using information from, for example, a local database 220, a remote database 270 and/or using other information.

In some embodiments, the system determines that several options are available for a given trip portion. For example, travel between a hotel lobby and an airport may be possible by either taxi or bus. The system can ask a passenger which option he or she prefers, or the system can use a default option.

In a method act 630, transit times are determined for the trip portions. For example, a travel time for the elevator portion is determined and a travel time for a non-elevator portion is determined. In various embodiments, the travel time for a trip portion can be determined based in part on possible delays due to maintenance, roadwork, detours, traffic levels, other elevator system reservations and/or other factors. Information about such delays can be real-time or pre-determined. The travel time for a trip portion can also include additional time to account, for example, for walking between transportation modes (e.g., between an elevator lobby and a bus stop) and/or for individual needs of a passenger (e.g., a limited walking speed due to age or disability).

The method act 630 can be performed using information from one or more of the databases 220, 270 and/or using other information. The method act 630 can also be performed using, for example, techniques similar to those used by software programs that plan travel routes and/or driving directions. In further embodiments, additional techniques can be used.

In a method act 640, the system schedules an elevator call for an elevator portion of the passenger trip. The elevator call is scheduled based on the transit times determined for the trip portions. The elevator call is scheduled such that the passenger will be able to arrive at the destination by the requested arrival time and (in cases where the elevator portion is not the final portion of the trip) timely proceed to the following portion of the passenger trip. The scheduling can include determining an elevator car assignment. The scheduling can be performed using one or more scheduling algorithms.

In a method act 650, a departure time for the passenger trip (e.g., when the passenger should begin the first portion of the trip) is communicated to the passenger. This can include, for example, communicating to the passenger when he or she should board an elevator. An elevator assignment can also be communicated to the passenger. It can also include, for example, when and where the passenger should catch a train, bus or other mode of transportation. It can also include a time when the passenger should depart by automobile.

In a method act 660, the system sends an elevator car to pick up the passenger at the scheduled time for the elevator portion of the trip.

Figure 7A:
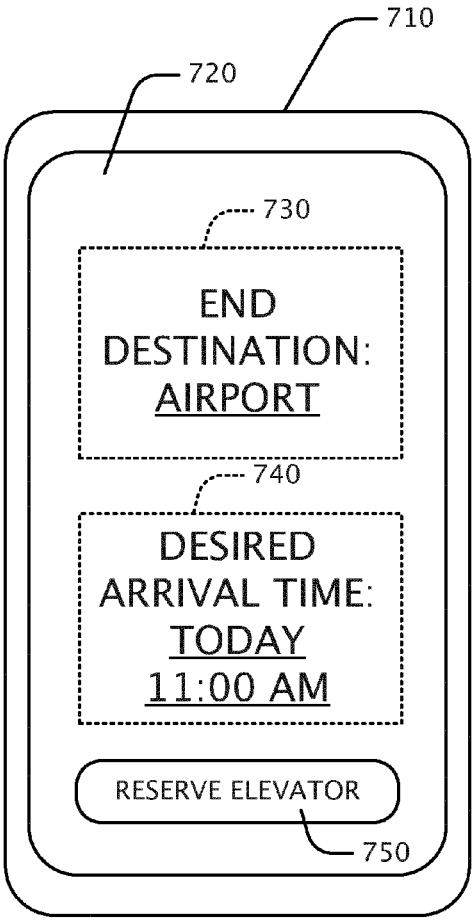
FIGS. 7A and 7B show an exemplary embodiment of an electronic device that can be used with embodiments of methods of scheduling use of an elevator.

FIG. 7A shows an exemplary embodiment of an electronic device (in this case, a mobile telephone 710) that can be used in conjunction with at least some embodiments of the methods 500 and 600. In this particular embodiment, the mobile telephone 710 comprises a touch screen 720, but other embodiments can use a variety of input devices and output devices. In FIG. 7A, the touch screen 720 displays an input area 730 for receiving an end destination of a passenger trip. In the depicted case, the input destination is "AIRPORT." The touch screen 720 also displays an input area 740 for indicating a desired arrival time at the end destination. In the depicted case, the input desired arrival time is "TODAY 11:00 AM." A user can use a button 750 to submit the trip information and reserve an elevator. In further embodiments, one or more other user interface elements are used. Additional information can also be provided by the user through the telephone 710. For example, the user can indicate a preferred mode of transportation, how many other people will be traveling with the passenger, how much luggage the passenger will bring and/or information about any reminders the passenger wishes to receive prior to departure.

Figure 7B:
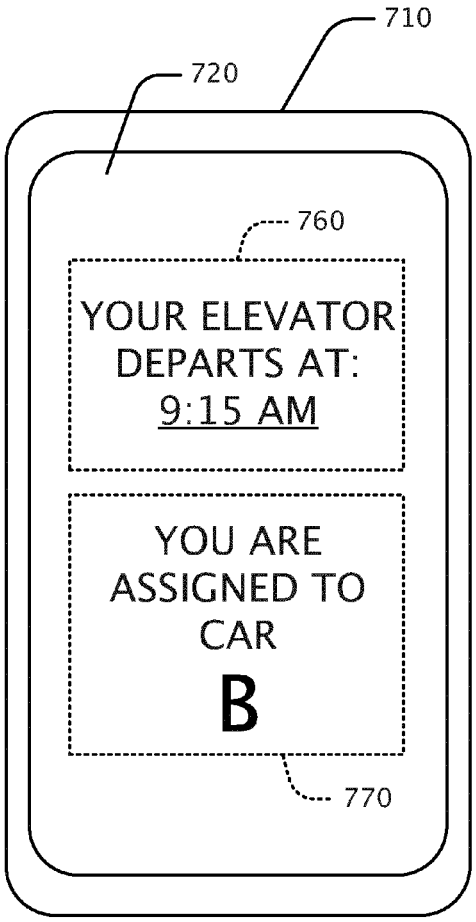

FIG. 7B shows an exemplary embodiment of the mobile telephone 710 after receiving departure information for the passenger trip. The reserved departure elevator time for the passenger trip appears in a display area 760. In this case, the elevator is scheduled to depart at 9:15 AM. An elevator car assignment appears in a display area 770. In this case, the passenger is assigned to board elevator car B. Additional information about the trip can also be provided to the user through the telephone 710. For example, the telephone 710 can communicate details about modes of transportation for the trip, travel times for one or more trip portions and/or when the user will receive a reminder about the departure time.

Figure 8:
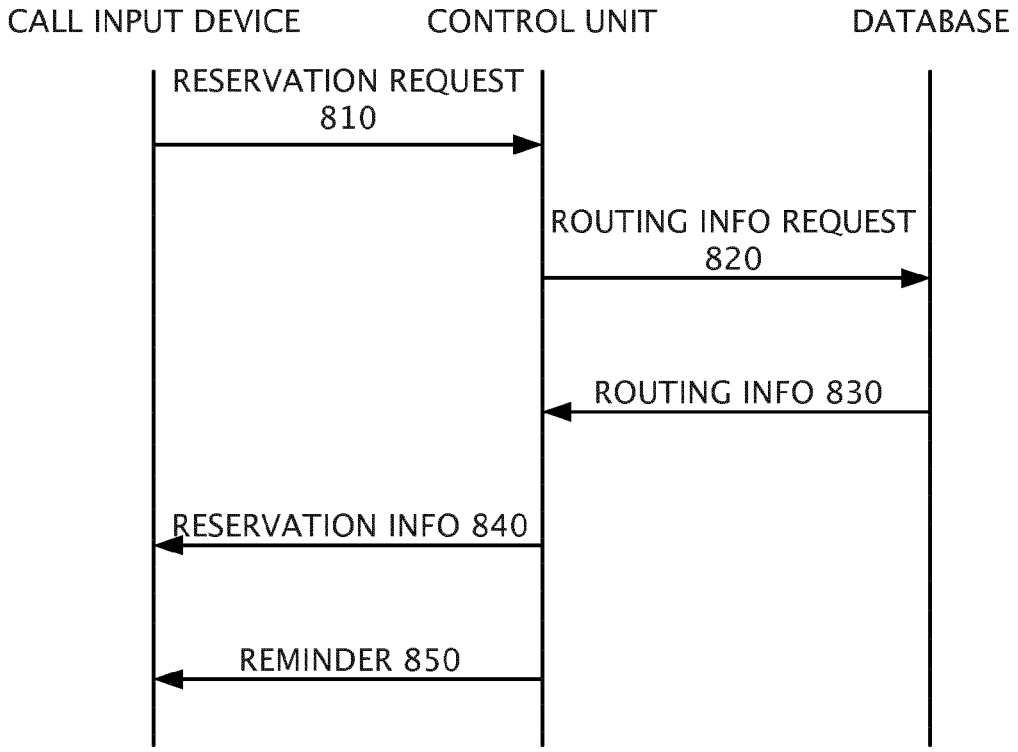
FIG. 8 shows a signal diagram for exemplary embodiments of a method for scheduling use of an elevator.

FIG. 8 shows a signal diagram for exemplary embodiments of a method for scheduling use of an elevator. A call input device (e.g., a stationary or semi stationary electronic device. or a portable electronic device, such as a mobile telephone) sends a reservation request 810 to a control unit. The control unit comprises, for example, a trip planning unit 280 and/or an elevator control unit 250. The reservation request includes passenger trip information. Based on the passenger trip information, the control unit sends a routing information request 820 to at least one local database and/or at least one remote database. The one or more databases return a signal 830 with the requested routing information. Based on the routing information, the control unit sends to the call input device a signal 840 containing reservation information for the passenger trip. Later, before the scheduled departure time, the control unit sends a reminder message 850 to the call input device. In some embodiments the reminder message 850 is sent to a different device than the device that was used to make the reservation request. For example, the reservation request can be placed using a wall-mounted call input device, while the reminder message 850 is sent to a mobile telephone (e.g., the passenger's mobile telephone).

Following is a non-limiting example of use of an exemplary embodiment of the disclosed technologies. A passenger is staying in a hotel room and preparing for his departure the next day. Using a call input device mounted on the wall of his hotel room, he inputs his destination ("AIRPORT") and his desired arrival time at that destination ("TOMORROW, 1 PM"). The passenger also indicates that he wishes to catch the elevator from the floor of his hotel room. This information is transmitted to a trip planning unit in the hotel building. Upon receiving the trip description, and based on information in local and remote databases, the trip planning unit determines that the passenger's trip to the airport consists of three portions: an elevator portion, a walking portion, and a train portion. The trip planning unit determines that the passenger should catch a train to the airport that departs tomorrow at 12:35 PM. The planning unit also estimates that, including five minutes of buffer time, the passenger will need ten minutes to walk from the hotel elevator lobby to the train station. The planning unit thus determines that the elevator system should deliver the passenger to the elevator lobby by 12:25 PM. Since the elevator trip from the passenger's room floor to the lobby will take an estimated two minutes, the planning unit reserves an elevator car for tomorrow at 12:23 PM. The planning unit passes this information to an elevator control unit. Once the reservation is made, the call input device displays the departure time and elevator assignment. The passenger indicates that he would like to receive a reminder of the departure 15 minutes beforehand. Accordingly, the next day at 12:08 PM, the passenger receives a message on his mobile telephone reminding him of his elevator departure time. At the scheduled departure time, the passenger leaves his room and enters his assigned elevator car.

Following is an additional non-limiting example of use of an exemplary embodiment of the disclosed technologies. In this example, a passenger wishes to travel from a train station to an office building in the same city for a meeting. Using an application on her mobile telephone, the passenger indicates her destination ("123 SW SALMON STREET, 10TH FLOOR") and the desired arrival time ("TODAY, 4 PM"). This information is transmitted as a trip description to a trip planning unit in the office building. Upon receiving the trip description, and based on information in local and remote databases, the trip planning unit determines that the passenger's trip to the proper floor of the office building consists of two portions: a bus portion and an elevator portion. The trip planning unit determines that the passenger should catch a bus from the train station at 3:30 PM. The planning unit also determines that this bus should allow the passenger to arrive at the lobby of the office building at 3:50 PM. The planning unit reserves an elevator car for the passenger at 3:51 PM. Based on expected and known elevator traffic demands for this time period in the office building, the planning unit calculates that the elevator car will bring the passenger to the 10th floor at 3:57 PM. The planning unit sends departure information to the passenger's mobile telephone, including departure time of the bus, the identifying number of the bus route, and an elevator car assignment for the office building. At the scheduled departure time, the passenger catches the indicated bus.

At least some embodiments of the disclosed technologies can allow for more efficient use of elevators, particularly when a passenger's trip involves an elevator and another means of transportation. For example, using the disclosed technologies, a user's trip can be planned in a manner that considers travel time in an elevator installation. A user can be aided in knowing when to depart on a trip that involves an elevator and when to catch an elevator for timely arrival at a destination. This can ease trip planning for users who travel from buildings having elevator installations, for example, tall buildings with elevator installations serving many floors. The disclosed technologies can also ease trip planning for visitors in unfamiliar areas.

Figure 9:
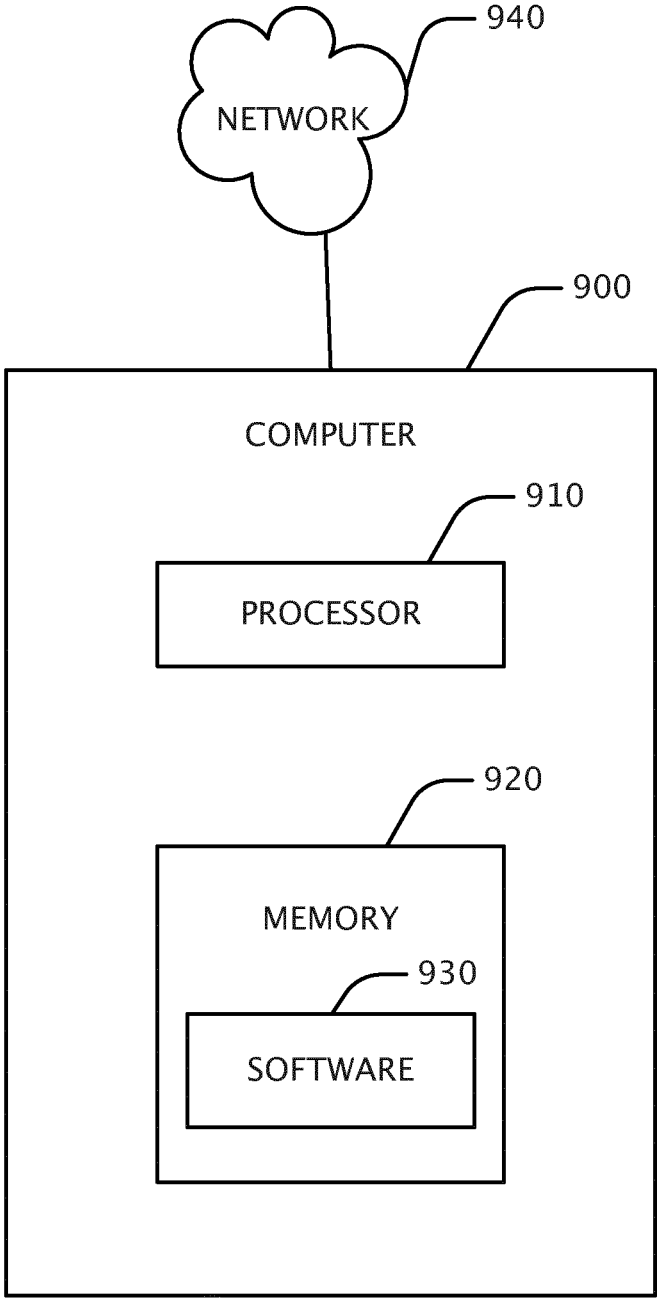
FIG. 9 shows a block diagram of an exemplary embodiment of a computer.

FIG. 9 shows a block diagram of an exemplary embodiment of a computer 900 (e.g., part of an elevator control unit, part of a trip planning unit, part of a call input device, part of a portable electronic device) that can be used with one or more technologies disclosed herein. The computer 900 comprises one or more processors 910. The processor 910 is coupled to a memory 920, which comprises one or more computer-readable storage media storing software instructions 930. When executed by the processor 910, the software instructions 930 cause the processor 910 to perform one or more method acts disclosed herein. Further embodiments of the computer 900 can comprise one or more additional components. The computer 900 can be connected to one or more other computers or electronic devices through an input/output component (not shown). In at least some embodiments, the computer 900 can connect to other computers or electronic devices through a network 940. In particular embodiments, the computer 900 works with one or more other computers, which are located locally and/or remotely. One or more of the disclosed methods can thus be performed using a distributed computing system.

In various embodiments, one or more method acts disclosed herein are performed by the trip planning unit 280 and/or by the elevator control unit 250. In further embodiments, one or more method acts are performed by one or more other computer-based components.

Although some embodiments of the various methods disclosed herein are described as comprising a certain number of method acts, further embodiments of a given method can comprise more or fewer method acts than are explicitly disclosed herein. In additional embodiments, method acts are performed in an order other than disclosed herein.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator method, comprising:

receiving a description of a passenger trip for a passenger, the passenger trip comprising an elevator portion and an additional portion, the description comprising a destination and a requested arrival time at the destination after completion of the additional portion and the elevator portion; and scheduling, for an elevator installation, an elevator call for the elevator portion of the passenger trip based on the destination and the requested arrival time.

2. The elevator method of claim 1, further comprising determining the elevator portion of the passenger trip and the additional portion of the passenger trip based on the destination and a starting point.

3. The elevator method of claim 2, further comprising determining a transit time for the elevator portion and a transit time for the additional portion.

4. The elevator method of claim 3, the transit time for the elevator portion being based on one or more elevator system delays.

5. The elevator method of claim 1, further comprising communicating an elevator departure time to the passenger.

6. The elevator method of claim 1, further comprising communicating to the passenger a departure time for the elevator portion or the additional portion.

7. The elevator method of claim 1, the elevator portion occurring in the passenger trip before the additional portion.

8. The elevator method of claim 1, the additional portion occurring in the passenger trip before the elevator portion.

9. The elevator method of claim 1, further comprising:

receiving the description of the passenger trip through a call input device; and communicating a departure time for the passenger trip to a portable electronic device, the portable electronic device being separate from the call input device.

10. The elevator method of claim 1, the elevator installation being in a building and the destination being outside of the building.

11. The elevator method of claim 1, the additional portion of the passenger trip involving at least one motor vehicle.

12. An elevator installation, comprising:

at least one elevator car disposed in an elevator shaft;

an elevator control computer coupled to the at least one elevator car; and a trip planning computer coupled to the elevator control computer, the trip planning computer being configured to, receive a description of a passenger trip, the passenger trip comprising an elevator portion and an additional portion, the description comprising a destination and a requested arrival time at the destination after completion of the additional portion and the elevator portion of the passenger trip, and schedule, for the elevator installation, an elevator call for the elevator portion of the passenger trip based on the destination and the requested arrival time.

13. The elevator installation of claim 12, further comprising a call input device coupled to the elevator control computer or the trip planning computer.

14. The elevator installation of claim 13, the call input device being in a room that is a starting point of the passenger trip.

15. One or more computer-readable storage media having encoded thereon instructions that, when executed by a processor, cause the processor to perform a method, the method comprising:

receiving a description of a passenger trip, the passenger trip comprising an elevator portion and an additional portion, the description comprising a destination and a requested arrival time at the destination after completion of the additional portion and of the elevator portion of the passenger trip; and scheduling, for an elevator installation an elevator call for the elevator portion of the passenger trip based on the destination and the requested arrival time.

* * * * *